US005611164A

United States Patent [19]

Rassias

[11] Patent Number: 5,611,164

[45] Date of Patent: Mar. 18, 1997

[54] SECURITY AND DEPLOYMENT ASSEMBLY

[76] Inventor: John N. Rassias, 1001 N.W. 12th Ter., Pompano Beach, Fla. 33069

[21] Appl. No.: 463,997

[22] Filed: Jun. 5, 1995

[51] Int. Cl.[6] ..... F41A 17/00

[52] U.S. Cl. ..... 42/70.11; 42/44; 42/51; 42/66; 42/70.01

[58] Field of Search ..... 42/70.11, 44, 51, 42/66, 70.01; 244/912, 243, 255

[56] References Cited

U.S. PATENT DOCUMENTS

| | | | |
|---|---|---|---|
| 633,939 | 9/1899 | Ackerman | 42/70.11 |
| 2,577,869 | 12/1951 | Adams | 224/2.2 |
| 2,893,615 | 7/1959 | Couper | 224/2 |
| 3,763,587 | 10/1973 | Firmalino | 42/1 R |
| 3,804,306 | 4/1974 | Azurin . | |
| 4,321,765 | 3/1982 | Gillum . | |
| 4,579,037 | 4/1986 | Gillum . | |
| 4,858,799 | 8/1989 | Young | 224/243 |
| 5,044,106 | 9/1991 | Slocum | 42/70.11 |
| 5,395,021 | 3/1995 | Brown | 224/244 |

OTHER PUBLICATIONS

Greenberg, "The Tactical Edge", *Combat Handguns*, Jun. 1995, pp. 56& 86.

Howe, "Officer Slain With Own Gun", *Combat Handguns*, Jun. 1995, pp. 24, 25, 89.

*Combat Handguns*, Jun. 1995, cover page, pp. 5, 7, 10, 11, 26–28, 30, 62, 88, one unnumbered page.

*Primary Examiner*—Charles T. Jordan
*Assistant Examiner*—Neena Chelliah
*Attorney, Agent, or Firm*—Webb Ziesenheim Bruening

[57] ABSTRACT

A locking assembly for a firearm, such as a semiautomatic or fully automatic pistol, includes a support member with an action locking arm and an action locking lug extending from a first end of the support member and a retainer arm extending from a second end of the support member. The action locking lug and arm are received in the firing chamber of a pistol, while the muzzle end of the pistol is rested on the retainer arm. A recoil spring in the pistol generates a pincer action between the action locking arm and the retainer arm to securely maintain the pistol in the locking assembly, preventing withdrawal with the normal upward movement. The action locking arm and lug positively prevent operation of the pistol trigger and prevent accidental chambering of an ammunition round. The pistol may be deployed with one downward thrust on the pistol grip, compressing the recoil spring and providing clearance for removal of the action locking arm and lug. Simultaneously, the pistol is cocked and a round is chambered so that upon removal from the locking assembly, the pistol is ready to fire. The locking assembly may be incorporated in a holster, or it may be more stationary, such as by mounting on the dashboard of a police squad car.

22 Claims, 4 Drawing Sheets

SECURITY AND DEPLOYMENT ASSEMBLY

BACKGROUND OF THE INVENTION

1. Field of the Invention

This invention is related to a locking assembly for semiautomatic pistols or automatic machine pistols and, more particularly, to a locking assembly which allows the user to safely carry a pistol, yet provides for drawing the pistol and readying the pistol to fire with only the action of the user's shooting hand.

2. Discussion of Prior Art

The most significant problem with existing military, law enforcement and civilian holsters is security of the weapon while being carried and safety in the deployment of the weapon from the holster. As a fully automatic or semiautomatic pistol is incapable of firing without a cartridge in battery within the pistol's chamber, a dilemma is created with the use of any conventional holster. The armed person must decide whether to carry the weapon without a cartridge chambered in battery; in which case the person must, after withdrawing the pistol from the holster, use two hands to hold the pistol and action the slide to chamber a cartridge into battery. In a fast action situation, this maneuver can prove extremely dangerous for the shooter and others nearby and may cost critical time when faced with the threat of immediate forceful action. For example, it is estimated that an average assailant can cover a distance of 21 feet in 1.5 seconds or less-faster than most officers or civilians can react, draw and fire their first shot. Greenberg, "The Tactical Edge" *Combat Handguns,* June 1995, p 86.

In the case of a single action semiautomatic pistol of the Colt 45 caliber and the 9 mm Browning Hi-Power types, the most prevalent models worldwide, both methods of carry, i.e., with or without a chambered cartridge, are extremely dangerous and prone to a myriad of problems. First, when carried with a cartridge chambered in battery, the hammer is cocked to the utmost rearward position. With a touch of the trigger the hammer will fall, striking the firing pin and discharging the firearm. This is by far the most dangerous carry method. Some personnel chamber a cartridge, engage the hammer safety, thereby restricting the fall of the hammer until the safety is manually disengaged, and place the pistol within the holster. Others chamber a cartridge, leave the safety off and rely on the conventional holster's restraining strap to keep the hammer from falling. This is equally dangerous. The users of the two chambered methods of carry subscribe to a personal philosophy that it is better to have a cartridge within the chamber rather than be required to use the other hand to action the slide to chamber a round. Both methods of carry with a cartridge chambered, whether with the safety or holster strap on or off, are compromised by the dangerous reality that a weapon so carried can easily be involuntarily discharged, often with a tragic outcome.

Military, law enforcement and civilian records are replete with accidents caused by the chambered cartridge carry method. Some personnel have forgotten that a cartridge was chambered and, upon withdrawing the pistol from the holster and removing the magazine from the pistol for cleaning or storage, have inadvertently discharged the chambered round. Others have accidentally dropped the weapon before unloading it, causing the hammer to strike the firing pin and resulting in unintentional injury or death. Other injuries and deaths have been caused by a scuffle between the wearer and an assailant whereby the weapon has fired in the attempt of the assailant to take the weapon out of the holster; and worse, when the assailant has successfully taken the weapon from the wearer and purposely used it against his victim and/or others. In 1986, there were 51 law enforcement officers killed by handguns. Twenty-nine percent (29%) of those deaths occurred with the officer's own handgun. Howe, "Officer Slain with Own Gun" *Combat Handguns,* June 1995, p 24. To date, very few inventors have come forth with even a reasonably practical solution to this problem. Id.

Many who select the chambered cartridge option believe that perhaps in some forceful circumstance their other hand may be otherwise engaged, as in fending off an assailant, driving, climbing, using a flashlight, etc., or their other hand may be injured, thereby making it physically impossible to chamber a cartridge by actioning the slide. They maintain that although their carry method is inherently dangerous, their weapon is accessible for use with one hand, after they have either released the manual safety or removed the holster strap, or both.

In both single or double action pistols, a cartridge may be pre-chambered and in battery and subject to being fired upon simply pulling the trigger. Consequently, the only other option of carrying a single or double action semiautomatic pistol is to carry it in the conventional holster with no cartridge chambered in battery. Although appearing to be a safer method, it also presents many dangerous possibilities. As both hands are required to chamber a round after the pistol is withdrawn from the conventional holster, the weapon cannot be used at all when one cannot use two hands. Additionally, personnel have inadvertently depressed the magazine release button which on some models is in a direct lateral path of the slide, while actioning the slide with their other hand, only to find their weapon has been rendered useless as the ammunition magazine has dropped out of the weapon. Finally, the only way to assure no round is chambered in semiautomatic or automatic pistols is to forcibly rack the pistol's slide to its most rearward position and visually or manually examine the firing chamber. This is often difficult or overlooked in low light or fast action situations. Extractor and ejector mechanisms on pistols have been known to malfunction due to wear, material fatigue or improper maintenance, giving weapon owners a false sense of security when the pistol slide is racked rearward and no cartridge is ejected. A holster which could obviate the need for visual or manual inspection would be advantageous.

U.S. Pat. No. 3,804,306 to Azurin discloses a conventional automatic pistol holster. The Azurin patent does not teach or suggest the features or advantages of the present invention. U.S. Pat. Nos. 2,577,869 to Adams and 2,893,615 to Couper, each directed to a holster for revolvers, likewise do not teach or suggest the present invention.

The object of the present invention is to allow military, law enforcement and authorized civilian personnel to carry a pistol with maximum safety to themselves and others with no cartridge capable of being in battery within the chamber. It is a further object to provide a locking assembly for a holster wherein a cartridge can be immediately chambered and the pistol withdrawn from the locking assembly using only one hand.

It is a still further object to provide a locking assembly having positive safety mechanisms which not only lock the weapon securely within the assembly but also uniquely prohibit a weapon which contains a cartridge in battery within the firing chamber to be placed inadvertently within the assembly.

Still further, it is an object of the present invention to provide a pistol which, when placed in the locking assembly, has an inoperable trigger and cannot be withdrawn from the assembly with the usual motion required in conventional holsters.

SUMMARY OF THE INVENTION

A locking assembly for a portable firearm has a support member and an action arm extending from a first end of the support member. The action arm carries a lug which is receivable in a firing chamber of the firearm. A retainer arm extends from a second end of the support member, and the lug and retainer arm captively retain the firearm between the chamber of the firearm and the firearm's muzzle. The lug may be shaped and dimensioned to be received in an end of a firearm barrel adjacent the chamber. The retainer arm may include a barrel port for passage of the barrel therethrough. The retainer arm may be contoured to conform to the shape of the firearm's muzzle.

The support member, action arm and retainer arm may be attached to a body plate on a holster.

The locking assembly may include a lock bar positioned on the locking assembly to engage the firearm and restrict movement of the firearm along its longitudinal axis. The lock bar may be located on the bottom of the retainer arm to restrict movement of the barrel through the barrel port. Alternatively, the lock bar may be on the support member adjacent the chamber of the firearm to engage part of the firearm adjacent the chamber and prevent movement along the firearm's longitudinal axis. In either case, the lock bar may be removably secured to the locking assembly by a customized securement device, such as a star bolt and corresponding tool.

The invention also includes a locking assembly for use with a portable firearm, the locking assembly having a longitudinal support member and an action arm extending from a first end of the support member and carrying a lug. The action arm and lug are receivable in the chamber of the firearm. The lug is receivable in the firearm's barrel, and a retainer arm extends from a second end of the support member. The firearm's muzzle may be engaged on the retainer arm. The retainer arm and the action arm are spaced from one another to captively retain the firearm between the firearm's chamber and muzzle and secure the firearm when mounted in the locking assembly.

Still further, the invention includes a method for securing a portable firearm, including the steps of providing a locking assembly with a longitudinal support member, an action arm extending from a first end of the support member and a retainer arm extending from a second end of the support member. The muzzle of the firearm is placed on the retainer arm, and the firearm grip is depressed in the direction of the retainer arm to move the barrel along the firearm's longitudinal axis and to place an ejection port on the firearm in registry with the action arm. Next, the action arm is inserted through the ejection port into a chamber of the firearm, and the grip is released to allow spring action recoil of the barrel. The firearm is thus captured between the action arm at the chamber and the retainer arm at the muzzle to secure the firearm in the locking assembly.

The method of the invention may also include the step of deploying the firearm by first depressing the grip in the direction of the retainer arm to move the barrel along the firearm's longitudinal axis, providing clearance for removal of the action arm from the chamber. Next, the firearm is tilted relative to the longitudinal axis of the locking assembly to remove the action arm from the chamber. Depression on the grip is continued to fully open the chamber and ready the firearm to fire. The firearm is then withdrawn from the holster.

Finally, the invention includes, in combination, a pistol and a holster. The pistol has a grip, a barrel, a muzzle and a sliding element, with the pistol defining a chamber having an ejection port adjacent a barrel face. The sliding element and the barrel are movable with respect to one another with a recoil spring interconnecting the two. The holster has a body plate and a locking assembly. The locking assembly extends transversely across the body plate and comprises a support member with an action arm carrying a finger-shaped lug, both extending from a first end of the support member. A retainer arm extends from a second end of the support member.

The lug and the action arm are located in the chamber of the pistol via the ejection port, with the lug received in the pistol's barrel at its barrel face. The muzzle engages the retainer arm. The pistol's recoil spring is thereby compressed. The pistol is held in the holster by the pincer action of the action arm and lug and the retainer arm. The recoil spring exerts equal and opposite forces on the retainer arm and the action arm.

Upon depression of the grip of the pistol, the muzzle bears on the retainer arm, the recoil spring is further compressed, and the barrel moves along the firearm's longitudinal axis to provide clearance for removal of the action arm and the lug from the chamber. The pistol may then be withdrawn from the holster.

The combined pistol and holster above may include a ramp on the body plate of the pistol to engage a trigger flap on the pistol when the grip is depressed, thereby aligning the trigger flap with a pistol trigger and placing the pistol in a safetyed condition. The combined pistol and holster may also include a barrel port and/or a lock bar, as described above.

Further details and advantages of the invention may be seen from the following detailed description, in conjunction with the accompanying drawings, wherein like reference numeral represent like parts.

DETAILED DESCRIPTION OF THE PREFERRED EMBODIMENTS

Figure 1:
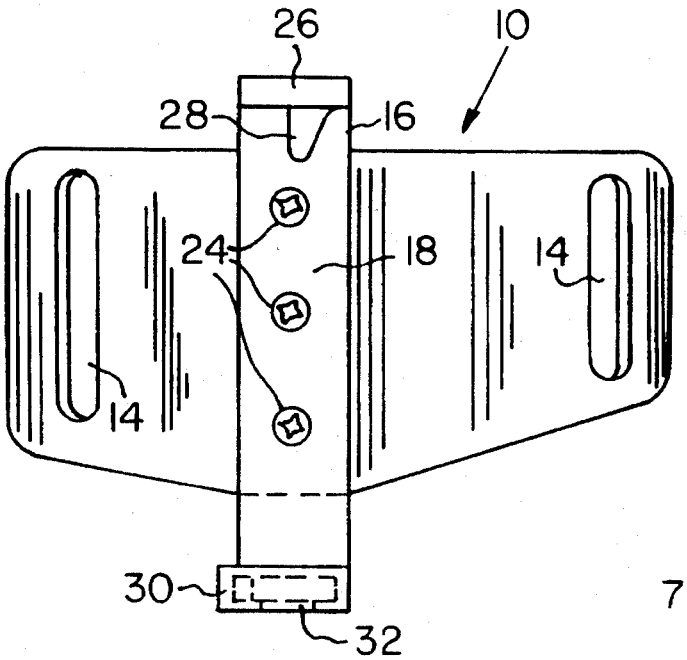
FIG. 1 is a front elevation view of a locking assembly on a holster according to the present invention.
Figure 2:
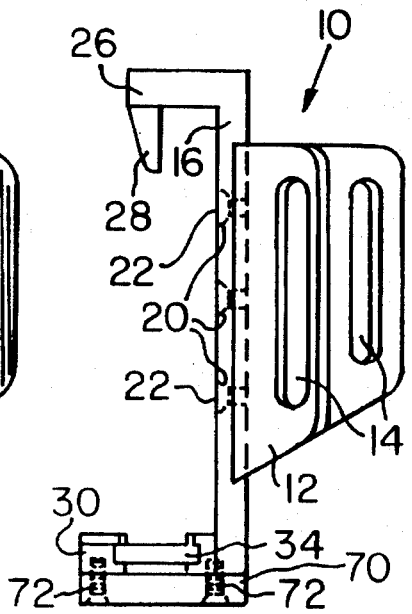
FIG. 2 is a side elevation view of a locking assembly according to the present invention, further including a lock bar.

Referring to FIGS. 1 and 2, the holster 10 of the present invention is made of two sections of aircraft high-strength aluminum, Zytel or other similar high-strength plastic composite. Materials which will not damage a pistol yet provide requisite strength and durability under extreme conditions of weather or force are expected to be appropriate for use in the present invention. A body plate 12 is designed to contour around the wearer's hip or torso, with openings 14 to accommodate a belt for wearing. An action locking assembly 16 extends transversely across the body plate 12 and is exactly dimensioned for the specific pistol to be secured. The action locking assembly 16 includes a flat support member 18 which includes countersunk holes 20 to receive bolts 22. The action locking assembly is removably secured in a vertical position to the body plate 12 by bolts 22. The bolts 22 are uniquely designed and customized for each individual holster so they may only be removed by a custom tool. For instance, the bolts 22 may include a star design 24, as shown in FIG. 1. The action locking assembly 16 also includes an action locking arm 26 extending from a first upper end of the support member 18. The action locking arm carries an action locking lug 28, which is finger shaped and extends downward from arm 26, generally parallel to support member 18 and perpendicular to arm 26.

A retainer arm 30 extends from a second lower end of support member 18. The retainer arm may include a barrel port 32 having a contoured or beveled rim 34, as described in further detail below. The body plate 12 can be used as a standard fitting fixed to specifically dimensioned action locking assemblies 16, which may be customized to accept specific weapons and can be designed for either right- or left-handed personnel and straight- or cross-draw mode. One user can purchase multiple action locking assemblies to accommodate his or her various weapons.

Figure 3:
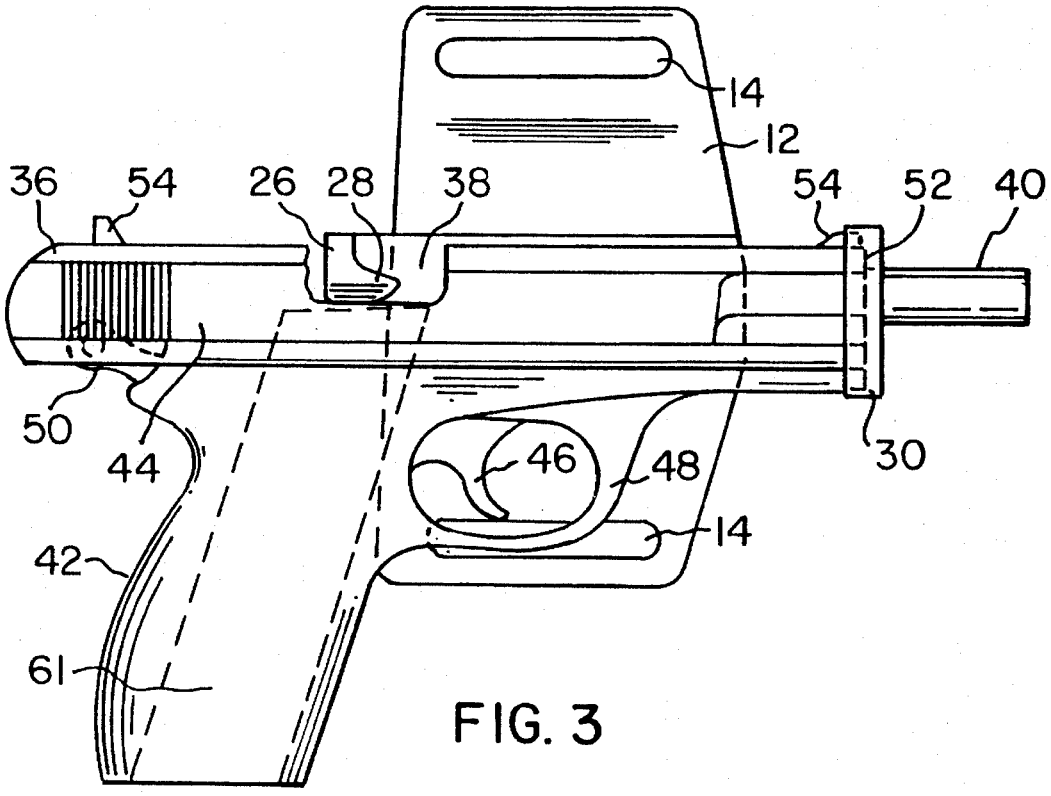
FIG. 3 is a front view of a closed bolt semiautomatic pistol, partially broken away, with the bolt in a fully open position to facilitate securing the pistol in the locking assembly of the present invention.

FIG. 3 depicts a double- or single-action closed bolt semiautomatic pistol 36 for mounting on the holster 10 of the present invention. Pistol 36 is shown with the bolt completely open to expose the firing chamber 38. There is no ammunition cartridge shown in the firing chamber or in battery. The pistol includes a barrel 40, a grip 42, and a sliding element 44. The phrase "in-battery" is meant to describe the condition where a cartridge is placed in the barrel 40 and is ready to be struck by the firing pin (not shown) for discharge. A trigger 46 with a trigger guard 48 and a hammer 50 are also shown. A muzzle 52 is located at the firing end of the pistol. The pistol also includes sights 54. The sliding element 44 includes an ejection port 56, which is basically a cutout in the top and side portions of the sliding element to expose the firing chamber 38.

Ejection port 56 opens toward the left, as the pistol 36 is pointed forward. The size and location of the ejection port, chamber and barrel varies from one model of pistol to another. Some ejection ports may open to the left, some to the right and some directly upward. Therefore, the size and configuration of the action arm 26 and lug 28 will have to be designed according to the particular firearm or class of firearms to be used with the holster 10. It is believed that, upon reading the instant specification, those of ordinary skill in the art will be able to custom design the action locking arm 26 and lug 28, and in some cases the size and contouring of the retainer arm 30, to achieve the present invention without undue experimentation.

Figure 4:
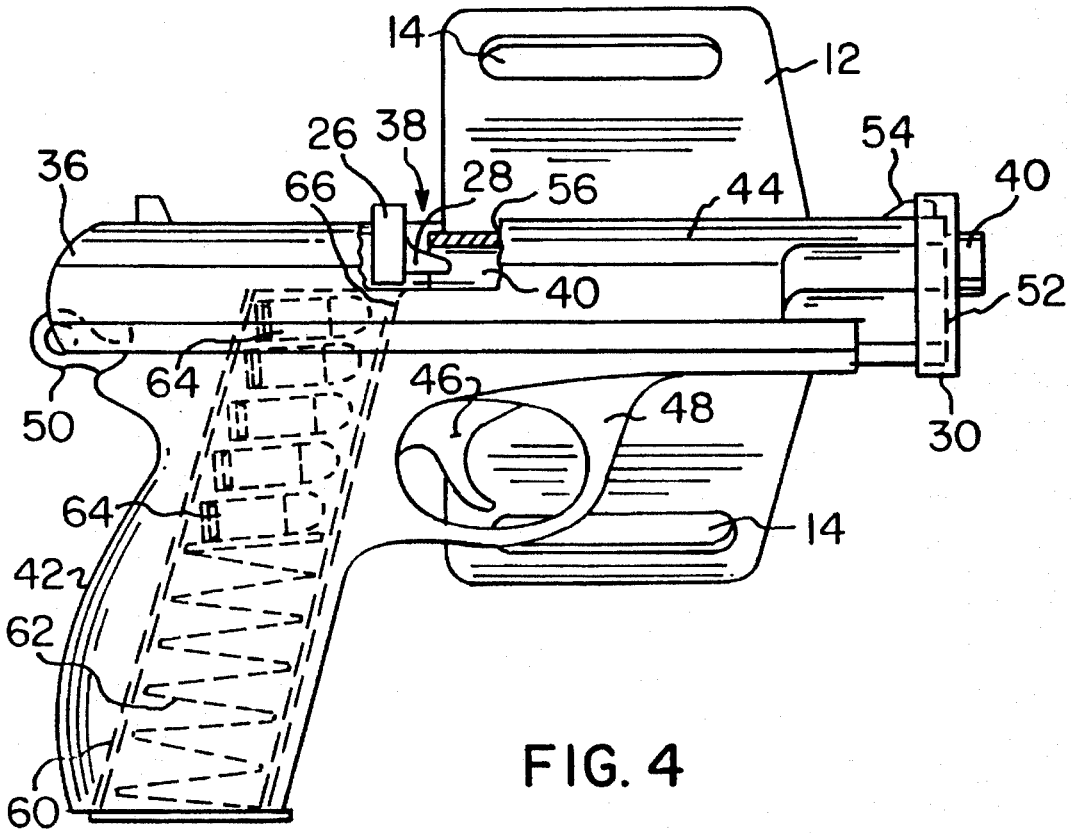
FIG. 4 is a front view of the pistol of FIG. 3 in its locked, secured position in the locking assembly of the present invention, and further showing a magazine with ammunition cartridges in the pistol.
Figure 5:
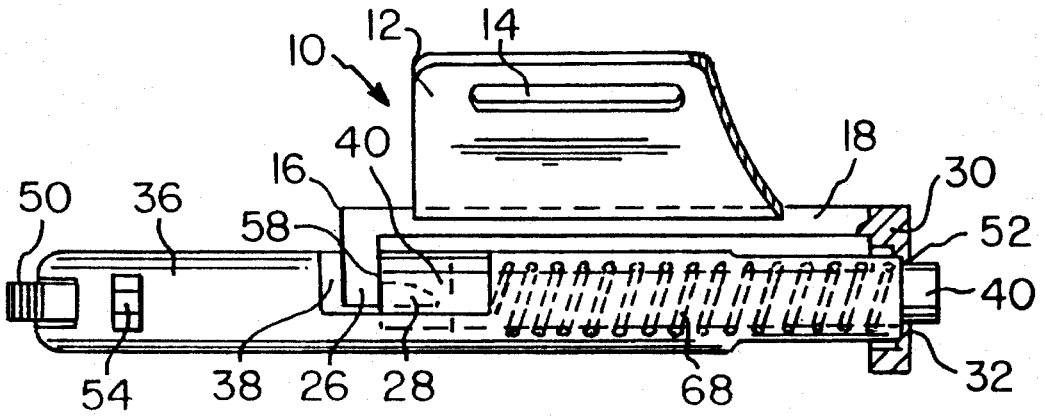
FIG. 5 is a top view of the pistol and locking assembly of FIG. 4.

As shown in FIG. 4, the barrel also includes a barrel face 58, and a magazine 60 may be loaded in a magazine well 61 in the grip 42 for feeding cartridges 64 to the firing chamber 38. Particularly, the magazine has a magazine spring 62 for feeding cartridges 64 to the firing chamber 38 via a feed ramp 66. As shown in FIG. 5, the sliding element and the barrel are interconnected by a main recoil spring 68 which provides for a spring action sliding motion between the barrel 40 and the sliding element 44.

In order to fully understand the invention, a brief description of the operation of the pistol 36 is in order. In the case of a single-action pistol, the trigger 46 will not function unless the hammer 50 is to the rearward (cocked) position. This position is shown in FIG. 3. The cocked position is established by either pulling the hammer 50 to the rear with the thumb of the hand not holding the pistol 36 or by racking the slide 44 to the rear. FIG. 3 shows slide 44 racked to its utmost rearward position. Racking the slide will set the hammer into the cocked position. When the slide 44 is pulled to its most rearward position, an extractor and an ejector (not shown) are designed to eject any chambered cartridge from the pistol 36 via ejection port 56. The movement of the slide 44 forward would then load another cartridge 64, under the combined action of the magazine spring 62 and feed ramp 66, into chamber 38 and in battery in barrel face 58.

When the slide 44 is racked rearward, the barrel 40 remains relatively stationary and thus extends from muzzle 52 a proportionate distance beyond slide 44. The same occurs if the grip 42 and barrel 40 are pushed forward and the slide 44 is made to remain stationary. In either case, the recoil spring 68 causes the slide 44 and barrel 40 to return to their normal position, i.e., with the firing end of barrel 40 coterminous with muzzle 52.

To secure the pistol 36 in holster 10, the magazine 60 and any cartridges 64 in chamber 38 are first removed from magazine well 61. The muzzle end 52 of pistol 36 is then placed on the retainer arm 30. Pressing with a slow, firm downward motion with the right hand (for right-handed personnel) on the grip 42 of the pistol 36, the chamber 38 is opened sufficiently to accommodate the finger-shaped lug 28 through ejection port 56 into chamber 38. This arrangement is shown in FIG. 3. The firm downward pressure on the grip of pistol 36 exerts pressure on the recoil spring 68, adding compressive force to the spring. The pistol 36 is tilted slightly inward (toward body plate 12) so that the lug 28 is aligned with the barrel face 58. Referring to FIG. 4, upon easing the downward pressure on grip 42, the barrel returns upward and the lug 28 is received in the barrel 40 at barrel face 58, while the action locking arm 26 is positioned in chamber 38, directly above the magazine well 61. The lug 28 is precisely configured to fit within the barrel of the particular weapon to be used with the holster. The length of the lug 28 should be such that the lug may be placed in the chamber and fitted into the barrel 40 when the slide 44 has moved to place chamber 38 in the half-open position. The lug 28 cannot be removed by any forward, backward, upward or lateral movement of the pistol 36 once the lug is positioned in barrel 40 and the downward pressure on grip 42 is released. The presence of the action locking arm 26 in chamber 38 prevents operation of trigger 46.

Release of pressure on the grip 42 allows the recoil spring 68 to expand to approximately half of its originally compressed state, and chamber 38 is closed to within the thickness of the action locking arm 26. As the force of the recoil spring 68 is exerting equal pressure on either end of the spring, the muzzle is firmly locked within the precisely contoured levels of the retainer arm 30. The retainer arm can be exactly contoured or indented to accept the specific muzzle of the pistol being used with the holster. The retainer arm may also be horseshoe shaped with an open end, if the muzzle of the particular pistol requires, for ease of removal. The lug 28 is at the same time firmly held within barrel 40 by the force of the recoil spring 68. The pistol is thus rigidly and safely held within the equally pressured pincers of the retainer arm 30 and the action locking arm 26 and lug 28 at opposite ends of the action locking assembly 16. Thus positioned, the pistol 36 cannot be removed from the holster 10 by normal upward motion, as is the case with conventional holsters. If an unauthorized attempt is made to withdraw the pistol from the holster by the normal upward motion, this attempt will be defeated because it is counteracted by the strength and rigid positioning of the lug 28 and action locking arm 26 within the barrel 40 and chamber 38, respectively.

After the pistol 36 is positioned in the action locking assembly, the wearer places a loaded magazine 60 into the magazine well 61. As the chamber 38 has been closed and locked by the action locking arm 26 and lug 28, no cartridges 64 can be placed within the chamber 38 itself as the action locking arm 26 is directly above the path of the cartridges 64. The only way to chamber a cartridge 64 into battery is to remove the obstructing action locking arm 26 and lug 28. Thus holstered, a pistol 36 can now be carried safely without a chambered cartridge 64. The specifically contoured levels of the retainer arm 30 stabilize the pistol 36 from any forward, backward, upward, downward or lateral movement.

To deploy the pistol, controlled speed is of primary importance. By a one-handed swift downward motion on the grip 42 of pistol 36, the chamber 38 is opened. Particularly, the downward pressure on grip 42 forces barrel 40 downward through the specifically designed barrel port 32 in retainer arm 30. The muzzle end of the slide 44 is retained against downward motion by the retainer arm 30. With the chamber 38 open and barrel face 58 moved downward, the action locking arm 26 and lug 28 may now be removed from chamber 38. The arm 26 and lug 28 are removed from chamber 38 with a slight tilting motion of the pistol 36 from the longitudinal axis of the action locking assembly 16, after the grip 42 and barrel 40 have been forced to the maximum downward position. At the same time, the hammer 50 is cocked by virtue of its contact with slide 44. The previously restricted cartridge 64 in magazine 40 is now free to proceed, under the force of magazine spring 62, up feed ramp 66 into chamber 38. The forward motion of slide 44 places the cartridge 64 in battery in barrel face 58. Thus, with the use of only one hand, the pistol 36 is now safely out of holster 10, with the cartridge 64 chambered in battery, ready to fire. A manual safety lever (not shown) on the pistol 36 may be employed by the user if the crisis requiring withdrawal of the pistol has eased.

When the crisis has abated, the chambered cartridge 64 is removed from chamber 38, and the magazine 60 is removed from grip 42. The pistol 36 is then placed into the holster 10, as described above. Once positioned in the holster 10, the pistol's magazine is placed back into grip 42. Again, there is no cartridge 64 chambered in battery.

To simply remove the pistol from the holster for storage, the magazine 60 is first removed from grip 42, thus assuring that no cartridges could enter the chamber 38 as they are all within the magazine 60. With the magazine set aside, the pistol can be removed from the holster as described above. The compressive force of spring 68 will then close the chamber 38, and the pistol 36 is thus in an unloaded and safe condition.

In passive, nonthreatening situations, the user may choose to carry the pistol 36 in holster 10 without the magazine 60. With conventional holsters, one must withdraw the pistol, work the action to extract and eject a chambered round and, after retrieving the unfired, ejected round, cleaning it and reloading it within the magazine, reholster the pistol. This situation is quite dangerous if one forgets that a round is in battery and merely removes the magazine, creating a hazardous condition. With the invention, the wearer may remove the magazine 60 from the pistol 36 without removing it from the holster 10. The magazine may be removed by pressing the appropriate release button on grip 42 (not shown) and pocketing the fully loaded magazine. The presence of locking arm 26 and lug 28 in chamber 38 ensures there is no cartridge 64 in battery. Rearming the weapon is easily accomplished by inserting the magazine within the grip with one hand.

Unlike the use of conventional holsters when used for storage, where one must rely on memory as to whether or not the weapon was stored with a loaded magazine or a cartridge in battery, storing a weapon locked within the invention assures no rounds are chambered, regardless of the status of the magazine.

The invention has an additional unique action locking safety device, one type for closed bolt, semiautomatic pistols and the other for open bolt, fully automatic machine pistols. For the closed bolt semiautomatic pistols, such as pistol 36, the holster 10 is provided with a specifically designed lock bar 70, as shown in FIG. 2. As described above in connection with support member 18, the lock bar 70 may be uniquely designed with a countersunk star bolt 72, requiring a custom tool (not shown). The tool and bolt may be serialized for each holster so that each is unique to the given holster. The lock bar 70 is positioned on a lower portion of retainer arm 30 after the pistol 36 has been secured in the holster. Thus positioned, the lock bar 70 prevents barrel 40 from extending through the barrel port 32. As described above, this motion of the barrel is necessary to provide clearance for removal of lug 28 from the barrel face 58. When the barrel 40 is restricted, the lug remains in the barrel face and the pistol 36 may not be removed from the action locking assembly 16. With the lock bar 70 installed, it is virtually impossible to remove the pistol 36 from the holster 10 without having the specific tool designed to be used in connection with the custom star bolts 72.

The holster 10 of the present invention may also be used with open bolt automatic machine pistols, such as the machine pistol shown and described in U.S. Pat. No. 4,579,037 referred to herein as the "CHAMP" pistol ("CHAMP" is an acronym for "controllable hand-held automatic machine pistol"). The CHAMP pistol 78 is shown in use with the holster 10 in FIGS. 6 and 7. The CHAMP pistol includes a bolt 80 and a shroud 82 with a recoil spring 84 and a barrel 86. A grip 88 with a magazine release 90 is adjacent a trigger 92 and trigger guard 94. The trigger guard includes a safety flap 96 which pivots with respect to the longitudinal plane of the CHAMP pistol 78 and is biased by spring 98. A chamber 100 is defined between bolt 80 and barrel face 102. In the embodiment shown in FIGS. 6 and 7, the chamber 100 is open toward the left as one holds the pistol 78 pointed forward. The action arm 26 and lug 28 thus fit directly into the chamber 100 when the pistol is carried on the right-hand waist of the holster wearer. Further details respecting the CHAMP pistol may be seen in U.S. Pat. No. 4,579,037, incorporated herein by reference.

When cocked, the bolt 80 of the CHAMP pistol 78 is placed at the rear of the weapon, with the first cartridge 64 aligned immediately in front of the bolt 80. Pressing the trigger will cause the bolt 80 to rapidly move forward, picking up the cartridge and placing it into the barrel face 102 (in battery) and instantaneously striking the primer to fire the round. The counterforce of the exploding round forces the bolt to the rear, opening the chamber 100 to expel the spent cartridge out of the ejection port (not shown). The CHAMP machine pistol 78 will keep functioning in this manner as long as pressure is maintained on trigger 92 or until all ammunition is expended. It is imperative that machine pistols be carried and deployed under conditions of utmost safety so as to protect users and bystanders. The invention can be made to accommodate virtually any well-known machine pistol, micro-submachine gun, etc., such as the mini-uzi, Cobray M-11, MAC-10, H&K MP-5K, Beretta, FN or Steyhr submachine guns or machine pistols.

Figure 6:
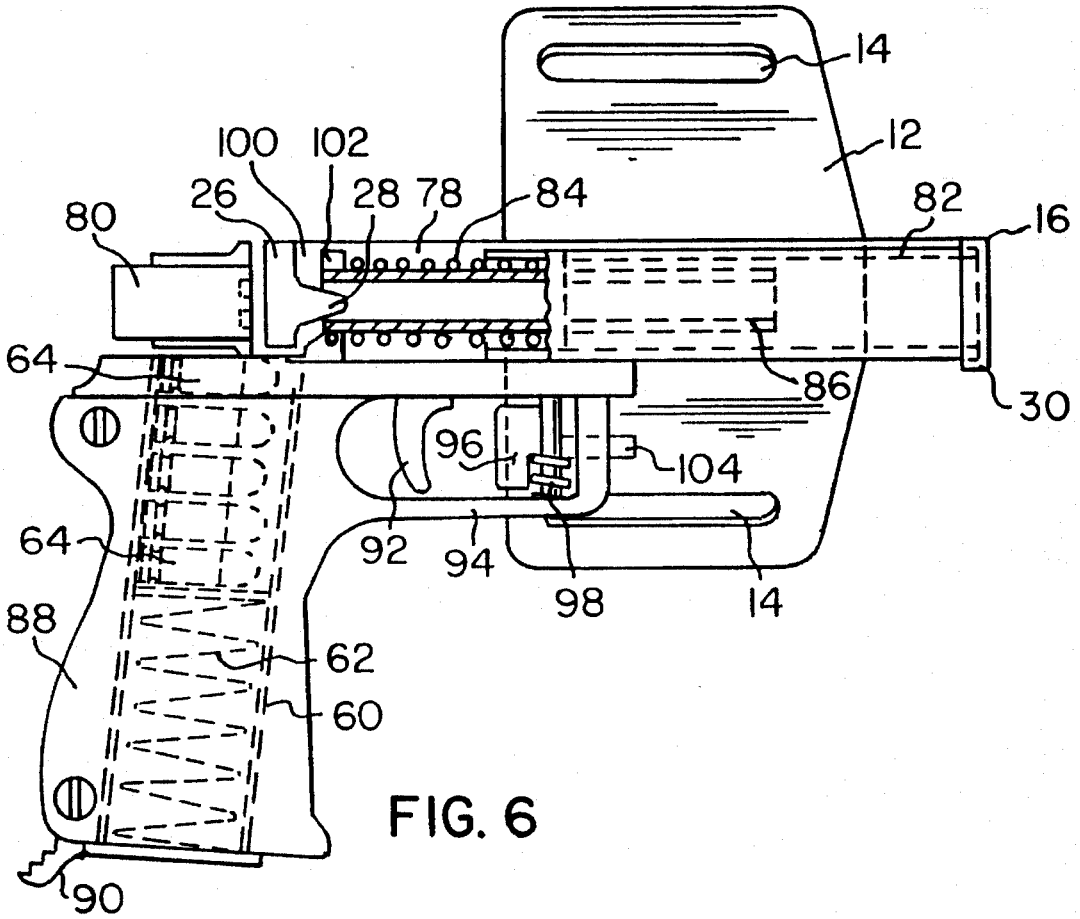
FIG. 6 is a front view of an open bolt fully automatic machine pistol, partially broken away and in partial cross-section, secured in a locking assembly and holster according to the present invention.
Figure 7:
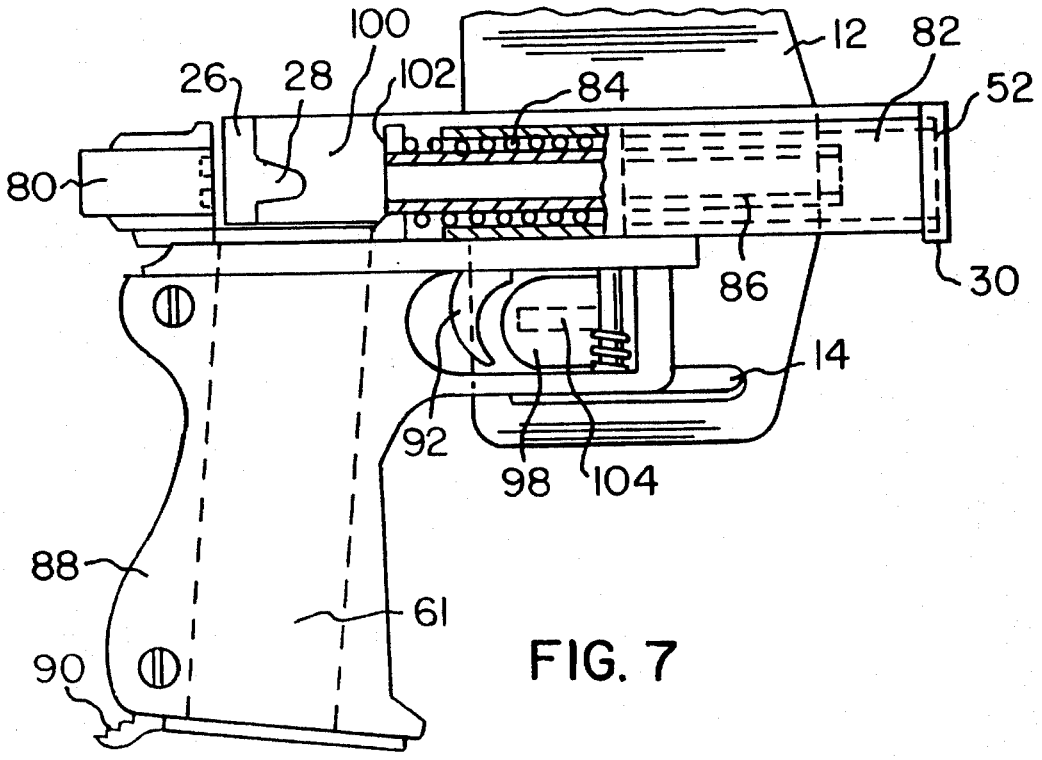
FIG. 7 is a front view of the pistol and locking assembly of FIG. 6, partially broken away and in partial cross-section, wherein the pistol grip is pressed downward so that the pistol may be deployed from the locking assembly.

As was the case with the semiautomatic pistol described above, the CHAMP 78 is positioned in the holster only after the magazine 60 is removed from grip 88. To mount the pistol 78 in holster 10, the user presses downward on grip 88 to open chamber 100 so that lug 28 and arm 26 may be received therein. The open chamber position is shown in FIG. 7. Once the lug is aligned with barrel face 102, the user presses trigger 92 and releases pressure on the grip, allowing the recoil spring 84 to carry the barrel up toward the lug so that the lug 28 is received in the barrel face 102, as shown in FIG. 6. The bolt also moves toward arm 26, when the trigger is pressed, so that the arm 26 and lug 28 are sandwiched between the bolt 80 and barrel face 102, as shown in FIG. 6.

If a cartridge were within the barrel face, the action locking lug 28 would be restricted from entry therein, thereby indicating to the user that the breech must be cleared before the weapon can be holstered. The action locking lug 28 should be specifically designed to be off-center from the plane of the firing pin on bolt 80 and the primer of the cartridge 64. This ensures that it is virtually impossible for the action locking lug 28 to involuntarily fire a round by contacting the primer. With the action locking arm 26 and lug 28 secured within the partially opened chamber 100, the force of the compressed recoil spring 84 generates a strong pincer action between the arm and lug 26, 28 and the retainer arm 30, locking the pistol 78 securely within the holster 10.

Even if a loaded magazine were inadvertently placed within the pistol 78 prior to lockup in holster 10, the bottom surface of bolt 80 and action locking arm 26 would push the uppermost cartridge 64 within the magazine down, out of alignment with the normal cartridge path to chamber 100, thus restricting the cartridge from entering the barrel face 102.

Deployment of the pistol 78 is the same as described above in connection with pistol 36.

The holster may also be provided with an automatic trigger safety activating ramp 104, specifically designed for the CHAMP pistol. Particularly, the trigger safety flap 96 remains out of line with the trigger 92, until the user exerts pressure downward on grip 88 to remove the pistol 78 from the holster 10. The downward movement of the pistol causes the trigger safety flap 96 to engage the inclined safety ramp 104, positioned on the body plate 12 in the appropriate location. The trigger safety flap thus rotates approximately 60° around the spring bias 98 so that access to the trigger 92 is blocked by the safety flap 96. Therefore, in order to fire the first round of the pistol 78, the user's finger must push the trigger safety flap 96 to its open position.

When reholstering the pistol 78, the magazine is removed from the pistol, the chamber 100 is cleared and the action locking arm 26 and lug 28 are positioned into the chamber 100, as discussed above.

Figure 8:
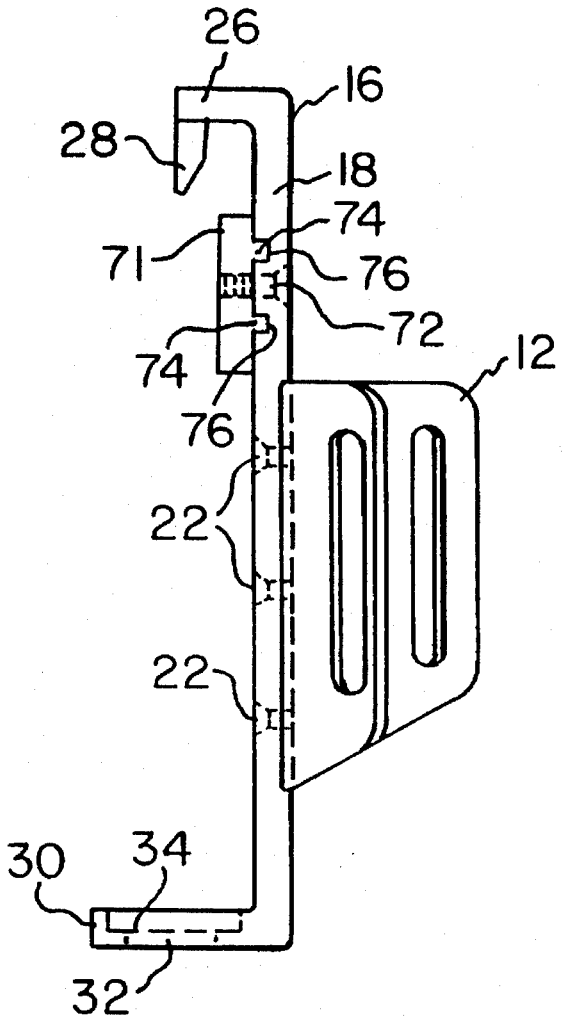
FIG. 8 is a side elevation view of a locking assembly according to the present invention, including an alternative lock bar arrangement.
Figure 9:
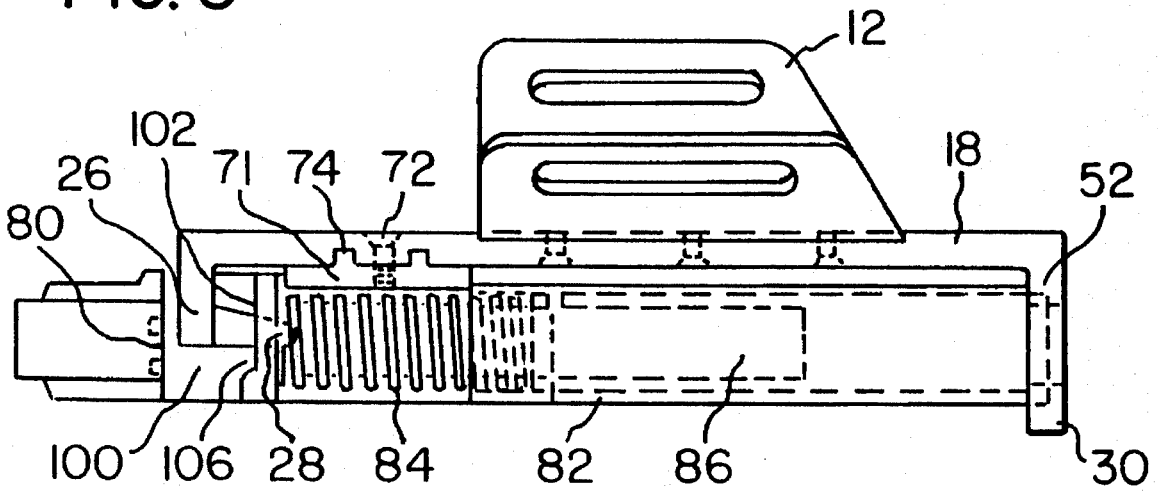
FIG. 9 is a top view of the pistol and locking assembly of FIG. 6, showing a lock bar positioned adjacent the pistol's firing chamber.

Referring to FIGS. 8 and 9, an alternate lock bar assembly is shown for use with open bolt automatic pistols. In this embodiment, lock bar 71 is secured on support member 18 by star bolt 72. Lock bar 71 includes two ribs 74, which are received in grooves 76 on support member 18 to prevent rotation of the lock bar 71 relative to the support member 18. The location and size of the lock bar 71 in this embodiment would be tailored to the weapon to be secured. For pistol 78, the lock bar 71 may be positioned in the action of the weapon, between the shroud 82 and a portion 106 of the pistol adjacent the firing chamber, as shown in FIG. 9. The lock bar 71 engages portion 106 to prevent its movement along the pistol's longitudinal axis when the grip 88 is pressed downward. The chamber 100 cannot then be further opened to permit withdrawal of action arm 26 and lug 28, and the weapon is thus totally locked within the holster 10. Pistol 78 may only be removed from holster 10 by first removing the lock bar 71 with a specific tool customized to fit the star bolt 72. The ribs 74 slide within grooves 76 for lifting the lock bar 71 out of the pistol's action.

It is contemplated that, in some applications, it will be desirable to provide a spring-loaded, hinged action locking arm 26 and/or action locking lug 28. For example, the action locking lug 28 may be loaded with a recessed spring. The spring would remain compressed, keeping the lug 28 in alignment with the firearm's barrel when in the holster 10. As downward pressure is applied to the firearm and the firearm is tilted outward, the lug 28 pivots out of the barrel and ejection port, and the spring returns the lug 28 to its proper position.

The unique action locking assembly 16 in the present invention obviates the question whether or not the safety is on when the firearm is positioned within the holster 10. When a firearm is carried within the holster of the present invention, it is by design always without a chambered cartridge and is incapable of being fired, until the pistol is withdrawn from the holster 10. When holstered, the wearer may disengage the safety on his or her weapon with confidence that the weapon cannot accidentally fire. This enhanced safety and rapid deployment feature of the present invention is unavailable from the prior art holsters. The position of the action locking arm 26 and lug 28 within the chamber of the firearm positively blocks and renders inoperative the trigger while the firearm is within the holster 10. The present invention not only assures a positive and safe locked carry method, but it also permits the rapid deployment of the firearm, ready to fire, by the use of only one hand. The ability to safely deploy a weapon with only one hand during a crisis situation allows wounded military or law enforcement personnel to actively defend themselves.

The present invention affords maximum concealability of even fully automatic weapons, without compromising safety and immediate access and deployment of the weapon. It is contemplated that a device for securing spare magazines to the holster, such as a spring clip or a sleeve, may be incorporated in the above-described invention. It is also contemplated that the holster of the present invention may be adapted for permanent or removable securement to the inside of a vehicle, such as a police squad car or an armored military tank so that the weapon may be readily available without the necessity of wearing the holster.

Having described the presently preferred embodiments of the invention, it will be understood that certain variations to the above-described embodiments may be made with the same results and without departing from the spirit and scope of the invention. For instance, various arrangements to wear the holster with a belt or with a shoulder harness for underarm use, in addition to the openings 14 shown and described above, will be obvious to those skilled in the art. The body plate and support member may be integrally manufactured or molded as one piece. The foregoing description and drawings are not intended to limit the invention, so that the scope of the invention may only be ascertained by reading the following claims.

I claim:

1. A locking assembly for a portable firearm having a barrel, a grip, a sliding element, a recoil spring and a muzzle, said sliding element defining a chamber, said locking assembly comprising:

a support member;

an action arm extending from a first end of said support member, said action arm carrying a lug, said lug receivable in the chamber of said firearm;

a muzzle retainer arm extending from a second end of said support member;

said action arm and lug and said muzzle retainer arm captively retaining the firearm between said chamber and said muzzle, said recoil spring exerting oppositely directed forces on said retainer arm and said action arm to secure the firearm when mounted in the locking assembly.

2. The locking assembly of claim 1 wherein said lug is shaped and dimensioned to be receivable in an end of said barrel adjacent said chamber.

3. The locking assembly of claim 2 wherein said lug is finger-shaped and its longitudinal dimension is in a plane perpendicular to said action arm and said muzzle retainer arm.

4. The locking assembly of claim 1 wherein said support member, said action arm and said muzzle retainer arm are attached to a holster.

5. The locking assembly of claim 1 wherein said muzzle retainer arm includes a barrel port for passage of said barrel therethrough, said muzzle retainer arm retaining said sliding element in a stationary position relative to said barrel, when a user depresses said grip in the direction of said muzzle retainer arm.

6. The locking assembly of claim 1 wherein said muzzle retainer arm is contoured to conform to said muzzle.

7. The locking assembly of claim 1 including a lock bar positioned on said locking assembly to engage said firearm and restrict movement of said firearm along the firearm's longitudinal axis.

8. The locking assembly of claim 7 wherein said lock bar is positioned, when the firearm is mounted in said locking assembly, to engage a portion of the firearm adjacent said chamber and restrict movement of said firearm along the firearm's longitudinal axis.

9. The locking assembly of claim 7 wherein said lock bar is removably secured to said support member by a customized securement device.

10. The locking assembly of claim 7 wherein said lock bar includes at least one protruding rib received in a corresponding slot on said support member to restrict relative movement of said lock bar and said support member.

11. The locking assembly of claim 7 wherein said lock bar is positioned on said muzzle retainer arm to restrict movement of said barrel in response to depression of said grip.

12. A locking assembly for use with a portable firearm, said firearm including a barrel, a grip, a sliding element, a recoil spring and a muzzle, said sliding element defining a chamber, said locking assembly comprising:

a longitudinal support member;

an action arm extending from a first end of said support member, said action arm carrying a lug, said action arm and lug receivable in the chamber of said firearm;

a retainer arm extending from a second end of said support member;

said lug receivable in said barrel and said muzzle engageable on said retainer arm, said retainer arm and action arm spaced from one another and said recoil spring exerting equal and oppositely directed forces on said retainer arm and said action arm to captively retain said firearm between said chamber and said muzzle to secure the firearm when mounted in the locking assembly.

13. A method for securing a portable firearm having a grip, a sliding element, a spring-loaded barrel and a muzzle, said firearm defining a chamber having an ejection port adjacent a barrel face, said method comprising:

(a) providing a locking assembly with a longitudinal support member, an action arm extending from a first end of said support member, and a retainer arm extending from a second end of said support member;

(b) placing said muzzle on said retainer arm;

(c) depressing said firearm grip in the direction of said retainer arm to move said barrel along the longitudinal axis of the firearm and place the ejection port in registry with said action arm;

(d) inserting said action arm through said ejection port into said chamber; and (e) releasing said grip to allow spring action recoil of said barrel and to capture the firearm between the action arm at said chamber and the retainer arm at said muzzle, thereby securing the firearm in the locking assembly.

14. The method of claim 13 including the step of deploying the firearm from the locking assembly by:

(f) depressing the grip in the direction of said retainer arm to move the barrel along the firearm's longitudinal axis, providing clearance for removal of the action arm from the chamber;

(g) tilting the firearm relative to the longitudinal axis of the locking assembly to remove the action arm from the chamber;

(h) further depressing said grip to fully open the chamber and ready the firearm for firing; and (i) withdrawing the firearm from the locking assembly.

15. The method of claim 13 wherein said action arm is provided with a lug and said lug is received in the barrel face in step (e).

16. In combination, a pistol and a holster, comprising:

a pistol having a grip, a barrel, a muzzle and a sliding element, said pistol defining a chamber having an ejection port adjacent a barrel face, said sliding element and said barrel connected by a recoil spring and movable with respect to one another along the longitudinal axis of the pistol;

a holster having a body plate and a locking assembly, said locking assembly extending transversely across said body plate and comprising a support member with an action arm carrying a finger-shaped lug and extending from a first end of said support member and a retainer arm extending from a second end of said support member, said lug and said action arm located in the chamber of said pistol via said ejection port, said lug received in said barrel at said barrel face, said muzzle engaging said retainer arm, said recoil spring partially compressed to exert equal and opposite forces on said retainer arm and action arm;

whereby upon depression of said grip, said recoil spring is further compressed, said muzzle bears on said retainer arm and said barrel moves along the pistol's longitudinal axis to provide clearance for removal of said action arm and said lug from said chamber, thereby permitting withdrawal of the pistol from the holster.

17. The combination set forth in claim 16 including a barrel port in said retainer arm for passage of said barrel therethrough upon depression of said pistol grip.

18. The combination set forth in claim 16 including a lock bar positioned on said holster to engage said pistol and restrict movement of said barrel along the pistol's longitudinal axis, preventing removal of said action arm and said lug from said chamber and preventing withdrawal of the pistol from the holster.

19. The combination set forth in claim 16 including a ramp on said body plate to engage a trigger flap on said pistol when said grip is depressed, thereby aligning the trigger flap with a pistol trigger and placing the pistol in a safetyed condition.

20. The combination set forth in claim 18 wherein said lock bar is removably secured to said holster by a customized securement device.

21. A locking assembly for a portable firearm having a barrel, a grip, a sliding element and a muzzle, said sliding element defining a chamber, said locking assembly comprising:

a support member;

an action arm extending from a first end of said support member, said action arm carrying a lug, said lug receivable in the chamber of said firearm;

a muzzle retainer arm extending from a second end of said support member;

said action arm and lug and said muzzle retainer arm captively retaining the firearm between said chamber and said muzzle to secure the firearm when mounted in the locking assembly;

said support member, said action arm and said muzzle retainer arm being attached to a holster.

22. A locking assembly for a portable firearm having a barrel, a grip, a sliding element and a muzzle, said sliding element defining a chamber, said locking assembly comprising:

a support member;

an action arm extending from a first end of said support member, said action arm carrying a lug, said lug receivable in the chamber of said firearm;

a muzzle retainer arm extending from a second end of said support member;

said action arm and lug and said muzzle retainer arm captively retaining the firearm between said chamber and said muzzle to secure the firearm when mounted in the locking assembly;

said muzzle retainer arm including a barrel port for passage of said barrel therethrough, said muzzle retainer arm retaining said sliding element in a stationary position relative to said barrel, when a user depresses said grip in the direction of said muzzle retainer arm.

* * * * *